US011940224B1

(12) United States Patent
Stiesdal

(10) Patent No.: US 11,940,224 B1
(45) Date of Patent: Mar. 26, 2024

(54) METHOD OF OPERATING A THERMAL ENERGY STORAGE SYSTEM

(71) Applicant: Stiesdal Storage A/S, Give (DK)

(72) Inventor: Henrik Stiesdal, Odense C (DK)

(73) Assignee: Stiesdal Storage A/S, Give (DK)

( * ) Notice: Subject to any disclaimer, the term of this patent is extended or adjusted under 35 U.S.C. 154(b) by 0 days.

(21) Appl. No.: 18/279,816

(22) PCT Filed: Mar. 2, 2022

(86) PCT No.: PCT/DK2022/050034

§ 371 (c)(1),
(2) Date: Aug. 31, 2023

(87) PCT Pub. No.: WO2022/184219

PCT Pub. Date: Sep. 9, 2022

(30) Foreign Application Priority Data

Mar. 4, 2021 (DK) ..... PA 2021 00224

(51) Int. Cl.
*F28D 20/00* (2006.01)
*F01K 3/08* (2006.01)
*F01K 3/12* (2006.01)

(52) U.S. Cl.
CPC ..... *F28D 20/0056* (2013.01); *F01K 3/08* (2013.01); *F01K 3/12* (2013.01); *F28D 2020/0082* (2013.01)

(58) Field of Classification Search
None
See application file for complete search history.

(56) References Cited

U.S. PATENT DOCUMENTS 9,915,478 B2 * 3/2018 Hemrle ..... F24S 60/30
2012/0118554 A1 5/2012 Mathur et al.
2012/0319410 A1 12/2012 Ambrosek et al.
2014/0224447 A1 * 8/2014 Reznik ..... F28D 20/0056 165/10
2017/0350658 A1 * 12/2017 Kerth ..... H02K 7/1823
(Continued)

FOREIGN PATENT DOCUMENTS

GB 2534914 A 8/2016
WO 2009044139 A2 4/2009
WO 2012127179 A1 9/2012
(Continued)

OTHER PUBLICATIONS

Fasquelle, T. et al., "Operating results of a thermocline thermal energy storage included in a parabolic trough mini power plant," AIP Conference Proceedings 1850, 080010, Jun. 27, 2017, 8 pages.
(Continued)

*Primary Examiner* — Shafiq Mian
(74) *Attorney, Agent, or Firm* — Elevated IP, LLC

(57) ABSTRACT

A method of operating an energy storage system (100), the system (100) comprising a thermodynamic cycle including a first thermal energy storage container (5) and an energy converter (1, 2, 3) for converting between electrical energy and thermal energy of the working fluid in the thermodynamic fluid cycle. For controlling the thermocline in the system without large thermal energy loss, it is pushed only partially out of the first thermal energy storage container (5).

15 Claims, 3 Drawing Sheets

(56) References Cited

U.S. PATENT DOCUMENTS

2018/0340712 A1* 11/2018 Peter ..... F28D 20/02

FOREIGN PATENT DOCUMENTS

| | | | |
|---|---|---|---|
| WO | 2015061261 | A1 | 4/2015 |
| WO | 2018073049 | A1 | 4/2018 |
| WO | 2020021014 | A1 | 1/2020 |
| WO | 2020174379 | A1 | 9/2020 |
| WO | 2020204933 | A1 | 10/2020 |

OTHER PUBLICATIONS

C. Mira-Hernandez et al., "Numerical simulation of single- and dual-media thermocline tanks for energy storage in concentrating solar power plants," Energy Procedia 49:916-926, 2014.

L. Geissbühler et al., "An assessment of thermocline-control methods for packed-bed thermal-energy storage in CSP plants, Part 1: Method descriptions," Solar Energy 178:341-350, 2019.

R. Guedez et al., "Techno-economic performance evaluation of solar tower plants with integrated multi-layered PCM thermocline thermal energy storage—A comparative study to conventional two-tank storage systems," AIP Conference Proceedings 1734:070012, 2016, 10 pages.

* cited by examiner

METHOD OF OPERATING A THERMAL ENERGY STORAGE SYSTEM

CROSS-REFERENCE TO RELATED APPLICATIONS

This application is a 371 national stage application of International Patent Application No. PCT/DK2022/050034, filed Mar. 2, 2022, which claims the benefit of and priority to Danish Application No. PA 2021 00224, filed Mar. 4, 2021, each of which is hereby incorporated by reference in its entirety.

FIELD OF THE INVENTION

The present invention relates to a method for counteracting thermocline degradation in thermal energy storage containers. In particular, it relates to a method of operating an energy storage system with a thermodynamic cycle according to the preamble of the independent claim.

BACKGROUND OF THE INVENTION

Sustainable electricity production by wind and solar power suffers from the fact that electricity is not necessarily demanded at the time of production and not necessarily available at the time of demand. Accordingly, various energy storage facilities have been proposed, where the electrical energy is transformed into heat and stored until there is a demand for transforming it back into electricity.

International patent application WO2009/044139 discloses a system comprising a first thermal energy storage (TES) container and a second TES container at a lower temperature, which are interconnected through a compressor/expander arrangement for increasing or decreasing the temperature in the first TEC container during charging or discharging of the system, respectively. When there is surplus electricity, a compressor is driven by an electrical engine, increasing the temperature of gas by compression, which is then used to heat a TES medium in the form of a bed of gravel in the first TES container. When there is a demand for electricity, the compressed hot gas is released from the first TES container through an expander which drives an electrical generator for recovering the electrical energy.

US2014/022447 discloses an installation for storing overcapacities of electricity as thermal energy. A vapor circuit connects a cold accumulator and a heat accumulator for evaporation of water and heating the vapor for energy transfer during discharging, whereas air as working fluid is used during charging.

During charging and discharging processes, a thermal front between hot and cold regions moves through the TES container from one end towards the other due to the gradual temperature changes in the TES container. During such movements of the thermal front, especially when the charging/discharging process is repeated, the temperature gradient tends to flatten between the two ends of the storage container, which is called thermocline degradation. Thermocline degradation is an effect of the temperature transition zone, also called thermocline zone or thermocline region, becoming wider. Thermocline degradation is not wanted because it decreases the overall efficiency of the system. Various methods have been proposed for counteracting such thermocline degradation by steepening the gradient and reducing the width of the thermocline zone.

WO2018/073049 mentions various thermocline control concepts, of which one is to push the thermocline out of the storage container or, in other words, extract the thermocline. This terminology is used when heating of the TES medium in the container is continued until the temperature at the end of the TES container is increased above the minimum temperature in the container, potentially up to the maximum temperature where no temperature gradient exists any more inside the container.

Thermocline development is discussed and illustrated on the basis of measurements in the article, "Operating results of a thermocline thermal energy storage included in a parabolic trough mini power plant" published by Fasquelle et al. in AIP Conference Proceedings 1850, 080010 (2017), which can be found on the Internet address https://doi.org/10.1063/1.4984131. The article discloses a system efficiency of 84% when a temperature of 247° C. was reached at the end of the tank, which operated between a minimum temperature of 220° C. and a maximum of 300° C. However, the article also emphasizes that a typical charging consists of heating the tank until the tank is entirely at the maximum temperature of 300° C.

With the above terminology, the latter implies that the thermocline is completely extracted or pushed entirely out of the tank. However, pushing a thermocline entirely out of a container has a disadvantage of reducing the overall efficiency of the storage system, which is well known.

For this reason, GB2534914 discusses that it is usually desired to keep the thermocline inside the TES container but that it can be useful under certain circumstances to slightly raise the temperature at the end of the TES container.

WO2012/127179 and WO2015/061261 discuss thermocline degradation and disclose as a countermeasure an arrangement of four TES containers interconnected serially so that the thermocline from one container is pushed to the subsequent serially connected container. The TES container in which the thermocline has been pushed completely out, and the entire TES medium in the TES container has the same temperature, is regarded as fully charged. Although, this is an improvement with respect to thermocline degradation in the first three TES containers, it does not solve the problem fully, because the thermocline is not pushed out of the last of the four TES containers. Accordingly, the problem of the thermocline degradation has not been fully solved for the entire TES container system. Rather, the thermocline has been moved to the end of a lengthwise extended TES container, which is also discussed, illustrated and motivated in WO2015/061261.

In this connection, it is important to mention that costs for establishing such types of TES systems are strongly related to the arrangements of TES containers. When TES containers for a certain fixed volume of storage are changed in the design by increasing their length and making them narrower, it may lead to a theoretically more efficient system due to a better control of the thermocline, but it also implies substantially increase of the construction costs. For example, in the systems of WO2012/127179 and WO2015/061261, the approach with four TES containers comes at a cost of increased amount of materials, number of components and service time for maintenance.

In WO2020/174379, which concerns solar heat stored in molten salt, various temperature profiles for thermoclines are illustrated in dependence of the charging time, for example a charging time of 8 hours at which the temperature at the end of the TES container has increased to about midway between the minimum and maximum temperatures. It is emphasized however, that the temperature at the end of the TES container is kept at the minimum temperature. This implies that the thermocline preferably is kept fully inside the TES container.

As this discussion of the prior art reveals, the problem of thermocline degradation in TES systems is very well known as well as countermeasures. However, when considering optimization of efficiency in view of costs for establishing, maintaining, and operating the TES systems, no consensus has yet been reached. Rather, the approaches follow different philosophies between, on the one hand, optimum utilization of the available energy by keeping the thermocline inside the TES container, and on the other hand, minimization of thermocline degradation, by entirely pushing the thermocline out of the TES container. These approaches go in opposite directions and are incompatible.

Accordingly, there is still a need for improvement with respect to optimization of energy storage systems.

DESCRIPTION/SUMMARY OF THE INVENTION

It is therefore an objective of the invention to provide an improvement in the art. In particular, it is an objective to provide a thermal energy storage (TES) system and a method of operating it which optimizes the system with respect to thermocline control, where the temperature gradient in the thermocline zone is kept steep. It is also an objective to provide an improvement based on a balance between costs when operating the system. This objective and further advantages are achieved with a system and method as described below and in the claims.

In particular, the objective is achieved by controlling the thermocline in the TES system without large thermal energy loss, where the thermocline is pushed only partially out of the system.

As discussed in the introduction, the traditional operation of a thermodynamic cycle for TES systems, where the thermocline is held entirely inside the TES container, is not optimum due to the flattening of the temperature gradient and corresponding decrease of efficiency. On the other hand, an increase of the temperature at the end of the TES container to the maximum temperature is also not useful, as this also leads to thermal loss and decrease of efficiency. Accordingly, there must exists an interval between these two extremes with a partial extraction of the thermocline where an optimum balance is reached for, on the one hand, maintaining satisfactory steepness of the temperature gradient and, on the other hand, not having a substantial thermal loss by pushing the thermocline too far out.

This problem becomes the more complex when financial profitability is added as a criterion. This important aspect for many systems has not been discussed in the prior art in detail in relation to the problem of thermocline degradation and countermeasures thereof. More holistic considerations should imply an aspect of the varying prices for electricity that are used for charging the TES system. It is obvious that the prices for electricity fall when there is a higher production than demand, for example solar energy on sunny days or wind energy on windy days, but the price development of electricity is not simple, as the supply and demand also change during day time and during season. Therefore, in a more comprehensive approach to optimization, considerations have to be included with respect to various factors that influence the overall performance index of a system, which includes:

costs for establishment and maintenance, optimization of efficiency during operation, electricity costs during operation.

The first factor concerning establishment and maintenance of the TES system favours simple systems with fewer containers, for example one TES container, rather than many serial containers. The second factor of optimization of the efficiency implies a balance between keeping the thermocline within the container for maximum utilization of the energy and pushing the thermocline out of the container in order to keep the gradient steep and the thermocline region narrow for increased conversion efficiency. The third factor is related to the operation in that a decrease in efficiency by pushing the thermocline out may be balanced by low electricity costs at the time of optimizing the thermocline into a narrower layer with a steeper gradient. For example, the time for optimizing the thermocline may be synchronized with periods where the costs for electricity are lowest, as this keeps the costs for regenerating the system to higher performance low as compared to the gained benefits afterwards.

Profitability of a TES system includes a balancing between the efficiency that can be reached between charging and discharging, including the conversion between electricity and thermal energy and a minimization of the construction and maintenance costs. A qualitative and semi-quantitative approach for such optimization is discussed in the following, where first an optimal overall regime for thermocline control and optimization is found, and where as a further step, cost considerations are added.

The term "thermocline control" is used herein, in agreement with the terminology used in the technical field, as describing the act of counteracting thermocline degradation and, thus, keeping the temperature gradient steep or steepening the temperature gradient as a regenerative measure in the thermocline zone in order to minimize the width of the thermocline zone. The term "thermocline regeneration" is used for the act of steepening the temperature gradient and decreasing the width of the thermocline zone, especially after thermocline degradation.

The initial objective for optimization of thermocline control is achieved as follows for a TES system comprising a thermodynamic cycle. The thermodynamic cycle includes a first TES container and an energy converter for conversion between electrical energy and thermal energy of the working fluid in the thermodynamic fluid cycle. When electrical energy is added to the energy converter, the converter converts the electrical energy to thermal energy in the form of added heat in the working fluid, and the thermal energy is then supplied to a TES container by the working fluid.

Accordingly, the thermodynamic fluid cycle comprises a first TES container for storing thermal energy. The container has a top and a bottom and contains a first TES medium for storing the received heat. The first TES medium has an upper end and a lower end. The top of the container is connected to a hot working fluid section of the thermodynamic fluid cycle and the bottom is connected to a cold working fluid section of the thermodynamic fluid cycle.

For example, the working fluid is a gas, although also thermodynamic cycles exist for liquids, such as molten salt, which was discussed in the introduction.

In embodiments, where the working fluid is gas, the energy converter advantageously comprises a motor-driven compressor configured for raising the temperature of the gas during a charging period by compressing the gas. Advantageously, the energy converter also comprises an expander-driven generator for generating electricity in a discharging period by expanding the gas through the expander and driving the expander by the expansion.

In practical embodiments, the system for the thermodynamic fluid cycle comprises a second TES container with a second TES medium. The tops of the first and second TES containers are then interconnected through the compressor and the bottoms through the expander during charging for transferring thermal energy from the second to the first TES media during charging. During discharging of the cycle, the tops are interconnected through the expander and the bottoms through the compressor for transferring thermal energy from the first to the second TES media during discharging. Advantageously, the compression in the compressor and the expansion in the expander are adiabatic and the thermal transfer between the gas and the thermal storage media is isobaric.

For regeneration of the thermocline the following method has been found useful.

During a period of charging, electrical energy is supplied to the energy converter and the electrical energy converted to thermal energy added to the working fluid, which is raising the temperature of the working fluid. The working fluid, for example gas, is provided to the top of the first TES container at a maximum temperature level $T_{max}$ for the storage of thermal energy. The thermal energy in the working fluid is transferred from the working fluid to the first TES medium by flow of the working fluid from the upper end to the first TES medium.

For example, the first TES medium is gas permeable, for example a bed of gravel, and the heated gas is traversing the medium from the upper to the lower end and leaving the TES container at the bottom.

The transfer of thermal energy in the first TES medium provides a temperature gradient from $T_{max}$ to $T_{min}$, where $T_{min}<T_{max}$. Here, $T_{max}$ is the temperature of the working fluid added at the top of the first TES container and the upper end of the first TES medium, and $T_{min}$ is the minimum temperature of the TES medium at the lower end after discharging and before start of charging. As initially discussed, the temperature gradient is contained in a thermocline zone of the TES medium. During charging, the gradient moves towards the lower end and at some instance, after a certain charging time, raises the temperature $T_{end}$ at the lower end to a level above $T_{min}$. This was discussed above as being equivalent to pushing the thermocline out of the TES container, which is beneficial for controlling steepness of the gradient, which in common terminology is also termed thermocline control.

By thorough study of the problem, it has been found that optimization of the system is advantageously done by increasing of the temperature $T_{end}$ at the lower end of the TES medium from the minimum temperature $T_{min}$ to a predetermined control temperature $T_C$, at which the thermocline is only pushed partially out of the container. This control temperature depends on various circumstances and parameters but is limited within a relatively narrow interval, positioned asymmetrically around a medium temperature $T_{mid}=T_{min}+1/2\ \Delta T$, where $\Delta T=T_{max}-T_{min}$. This interval for $T_C$ is defined as follows:

$$T_C \in [T_{min}+0.25\Delta T; T_{min}+0.65\Delta T], \text{ where } \Delta T=T_{max}-T_{min}.$$

Accordingly, electrical energy is added to the energy storage system to raise the temperature $T_{end}$ of the first TES medium at the lower end from $T_{min}$ only until $T_{end}$ reaches a predetermined control temperature $T_C$.

This interval is for convenience and identification herein called the thermocline control interval. It is readily observed that the interval is narrow in that it extends only to a value 25% of ΔT below the medium temperature $T_{mid}$ and 15% of ΔT above. Thus, the overall width of the interval is only 40% of ΔT.

For example, if $T_{min}$=20° C. and $T_{max}$=180° C., the interval extends only between 60° C. and 120° C., which is relatively narrow and asymmetric around $T_{mid}$=100° C.

Theses values have been found by semi-quantitative and empirical investigation, described in detail below.

As mentioned above, profit considerations are useful to include because the energy storage should be profitable in order to be attractive for storing surplus energy. The price $P_{el}$ per unit electricity may vary substantially, and profitability is obtained when the electricity for the converter is purchased at a low price for charging, and discharging is done with a conversion of the thermal energy to electricity when the price $P_{el}$ per unit electricity is high.

Advantageously, the method includes predetermining a maximum price $P_{max}$ for a unit electricity, which is a maximum profitable price that is acceptable for thermocline control or even thermocline regeneration in the system. Once this maximum price has been determined, it is compared with the actual price actual price $P_{act}$ for a unit electricity valid for the planned time of charging. Only when $P_{act}<P_{max}$, control or regeneration of the thermocline within the current charging cycle is found profitable, where the temperature $T_{end}$ at the end of the first thermal energy storage medium is raised to a predetermined level $T_C$ within the above-described thermocline control interval.

For example, in some charging cycles, the electricity price may be moderate enough for TES to be profitable but not low enough for optimized control. This may lead to a charging cycle in which a moderate flattening of the thermocline is accepted. Later, when the electricity price is at the lowest, the charging may be done such that $T_C$ is set to a higher value, and the temperature $T_{end}$ is raised correspondingly higher in the interval for $T_C$ and the thermocline is regenerated and the gradient is steepened again. Thus, there is a possibility to vary the predetermined $T_C$ level depending on the actual electricity price.

In order to predetermine a precise number for $T_C$ within the above-described thermocline control interval, there exists various models for functional dependence on the price $P_{el}$ for a unit electricity.

In general, it implies a decreasing function $$T_C(P_{el})=\text{funct}(P_{el}),$$

in which $T_C(P_{el})$ is dependent on a varying price $P_{el}$ for a unit of electricity, and the function $T_C(P_{el})$ is decreasing within the thermocline control interval for $T_C$ for increasing $P_{el}$ within an interval $P_{el}\in[P_{min}; P_{max}]$ of electricity prices, wherein $$T_C(P_{min})=T_{min}+0.65\Delta T.$$

and $$T_C(P_{max})=T_{min}+0.25\ \Delta T.$$

The interval and related function values does not necessarily imply that the function is not defined outside the interval.

In practice, an actual price $P_{act}$ for a unit of electricity is received for the planned time of charging, and $T_C(P_{act})$ determined on the basis of the specific function. Electrical energy is then supplied to the energy storage system for charging only until the temperature $T_{end}$ reaches the predetermined level $T_C(P_{act})$. This level is then regarded as the optimized level within the thermocline control interval.

For example, $T_C(P_{el})$=funct ($P_{el}$) is a function dependent of the price $P_{el}$ such that low electricity price with a $P_{el}$ below a pre-defined level $P_0 \in [P_{min}; P_{max}]$, for example in the lower half of the price interval $[P_{min}; P_{max}]$, leads to a value for $T_C$ from slightly below $T_{mid}$ to above $T_{mid}$, whereas for moderately expensive electricity, the value for $T_C$ is substantially below $T_{mid}$.

For example, In mathematical terms, such two intervals can be expressed as follows:

$$T_C(P_{el}) \in [T_{min}+0.45\Delta T; T_{min}+0.65\Delta T] \text{ if } P_{min} \leq P_{el} < P_0,$$

$$T_C(P_{el}) \in [T_{min}+0.25\Delta T; T_{min}+0.45\Delta T] \text{ if } P_0 \leq P_{el} \leq P_{max}.$$

$P_0 \in [P_{min}; P_{max}]$. For example, $P_0=(P_{max}+P_{min})/2$

An alternative is given by the intervals $$T_C(P_{el}) \in [T_{min}+0.40\Delta T; T_{min}+0.65\Delta T] \text{ if } P_{min} \leq P_{el} < P_0,$$

$$T_C(P_{el}) \in [T_{min}+0.25\Delta T; T_{min}+0.40\Delta T] \text{ if } P_0 \leq P_{el} \leq P_{max}.$$

$P_0 \in [P_{min}; P_{max}]$. Optionally, $P_0=(P_{max}+P_{min})/2$

A further alternative is found in the intervals $$T_C(P_{el}) \in [T_{min}+0.35\Delta T; T_{min}+0.65\Delta T] \text{ if } P_{min} \leq P_{el} < P_0,$$

$$T_C(P_{el}) \in [T_{min}+0.25\Delta T; T_{min}+0.35\Delta T] \text{ if } P_0 \leq P_{el} \leq P_{max}.$$

$P_0 \in [P_{min}; P_{max}]$. Optionally, $P_0=(P_{max}+P_{min})/2$

The function $T_C(P_{el})$ itself in a simple form can be a multi-step function with various decreasing values within the interval $[P_{min}; P_{max}]$. However, an alternative model is found in providing $T_C(P_{el})$=funct ($P_{el}$) as a continuous function, optionally linear function.

Typically, $P_{min}$ is determined as the lowest possible electricity price, or the lowest possible realistic price. However, this need not be the case, and in order to provide a generalized model for prices going to zero, a minimum value for $T_C$ is used, namely $$T_C(P_{el})=T_{min}+0.65\Delta T \text{ if } P_{el} \leq P_{min}.$$

One may ask whether it would make sense to increase $T_{end}$ even further than the given interval for $T_C$ when the electricity price drops. However, in general cases, this has not been found useful, as it is better, in this case, to maximize profit over further minimizing the width of the thermocline zone. The consideration behind this approach is that further steepening of the gradient in the thermocline zone with a temperature of $T_{end}$ above $T_{min}$+0.65 ΔT leads to substantial thermal losses, which are not regarded useful, especially not more useful than profit maximization.

The maximum price $P_{max}$ has been defined above as the price above which further decrease of the thermocline zone by raising $T_{end}$ into the thermocline control interval is not profitable any more. Thus, at prices $P_{el}>P_{max}$, energy storage by the system may still make sense, but possibly only outside the thermocline control regime.

When having the flattening of the thermocline in mind, which gets more pronounced with multiple charging, continuation of charging at $P_{el}>P_{max}$ would lead to a decrease in efficiency and decreasing profitability. Therefore, in some instances, one may predetermine the maximum price $P_{max}$ for a unit electricity as the maximum price that is acceptable for at all charging of the system. This implies that $P_{max}$ is the highest electricity price at which storage of energy by the system still is profitable. This would imply only charging the system by electricity consumption if $P_{act}<P_{max}$.

Typically, the temperature $T_{end}$ to a predetermined $T_C$ is achieved by the supply of electrical energy to the converter and by its conversion of the electrical energy to thermal energy. However, optionally in some cases, the supply of electrical energy to the system is a combination of electrical energy to the converter and electrical energy to a heater at the lower end of the first TES medium.

As it appears from the above, a model has been developed for thermocline control in general, which leads to a rather narrow interval for levels to which the temperature $T_{end}$ is raised in order to balance steepening of the gradient with the energy that has to be put into the system and the thermal loss that is acceptable.

SHORT DESCRIPTION OF THE DRAWINGS

The invention will be explained in more detail with reference to the drawing, where FIG. 1 illustrates a principle sketch of an energy storage system in A) charging cycle and B) discharging cycle;

DETAILED DESCRIPTION/PREFERRED EMBODIMENT

Figure 1A:
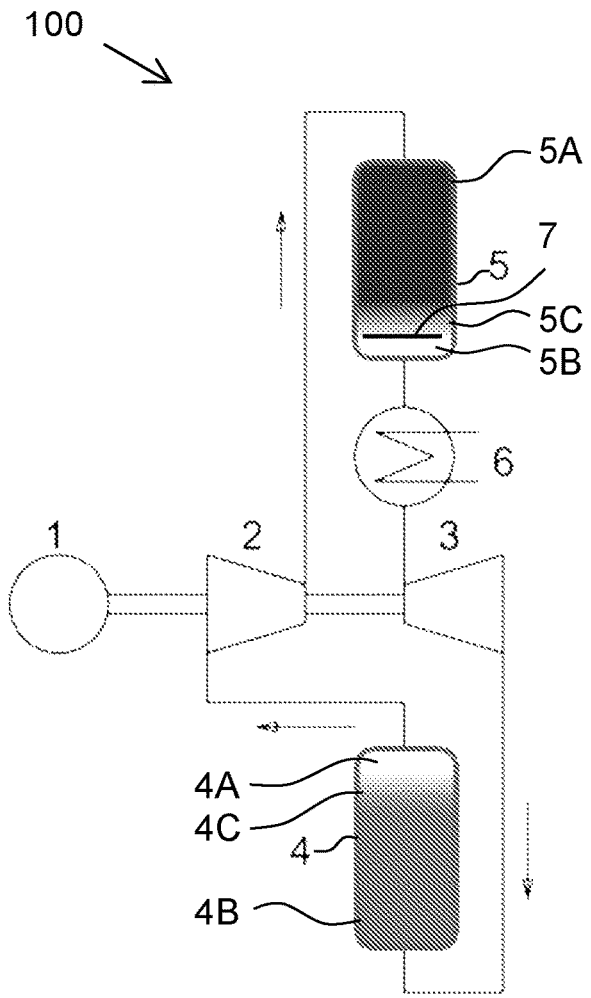
Figure 1B:
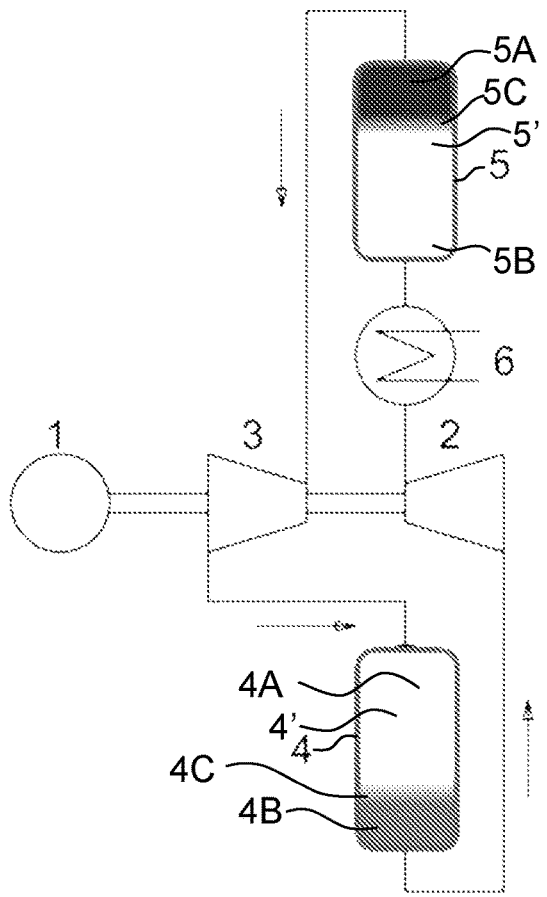

FIG. 1A illustrates a principle sketch of an thermal energy storage (TES) system 100 during a charging cycle, and FIG. 1B illustrates the system during a discharging cycle. The system comprises an electrical motor/generator 1 that is shaft-connected to a compressor 2 and expander 3. The system also comprises a first thermal energy storage (TES) container 5 containing a first gas-permeable TES medium 5', and a second TES container 4 containing a second gas-permeable TES medium 4'. For example, the medium is gravel.

During charging, the motor 1 drives the compressor 2 for compressing a gas, which is taken from the second container 4. The temperature of the gas from the second TES container increases by the compression in the compressor 2, and the hot gas from the compressor 2 exit is added to the top of the inner volume of the first TES container 5 for heating the first TES medium 5'.

While the compressed gas flows through the first TES medium 5' in the first TES container 5, it heats up the contained first TES medium 5', first in the top and subsequently further down. During the charging, the size of the hot-temperature volume 5A of the first TES medium 5' that has already attained the temperature of the compressed gas increases gradually, so that the heated hot-temperature volume 5A expands downwards in the first TES container 5 so that the low-temperature volume 5B of the first TES medium 5' correspondingly decreases.

For example, the temperature of the compressed gas is 600° C., which will be the temperature at the top of the first TES container 5 at the start of the charging. While the gas traverses the first TES container 5 it is cooled by thermal transfer to the first TES medium 5' inside the first TES container 5 and leaves the bottom of the first TES container at a lower temperature, for example at 75° C. It expands in the expander 3, which cools the gas further down, for example to −70° C. At this low temperature, the gas enters the bottom of the second TES container 4 and passes the second TES medium 4' in the second TES container 4 on its way from the bottom to the top, so that it gets heated, for example to 385° C., during its way through the second TES medium 4' in the second TES container 4 on its way from the bottom to the top, where it enters the cycle again. The low-temperature volume 4B of the second TES medium 4' increases during this process, while the high-temperature volume 4A in the second TES container 4 decreases correspondingly during the charging process.

Between the high-temperature volume 5A and the low-temperature volume 5B in the first TES container 5, the temperature transition region 5C with the temperature gradient from the high to the low temperature is called the thermocline zone. Similarly, the transition region with the thermocline zone 4C between the high-temperature volume 4A and the low-temperature volume 4B of the second TES medium 4' in the second TES container 4 is called a thermocline zone. These transition regions or thermocline zones 4C, 5C are desired narrow with a steep gradient.

As a measure for improving the efficiency, a heat exchanger 6 is provided in order to decrease the temperature of the gas on its way from the first TES container 5 to the second TES container 4 during charging.

The charging process is done when surplus electricity is available in the electricity system, for example from a solar power plant or wind turbines or from a more conventional electricity production plant using fossil fuel. The electricity drives the motor 1 for the charging process.

The pressure in the first TES container 5 and in the pipe system above the compressor 2 and expander 3 is higher than the pressure in the second TES container 4 and in the pipe system below the compressor 2 and expander 3. Accordingly, the region of the thermodynamic cycle above the compressor/expander is a high pressure region, and the region of the thermodynamic cycle below the compressor/expander is a low pressure region. The section between the tops of the TES containers has a temperature higher than the section between the bottoms of the TES containers, why the section between the tops of the TES containers is called a high temperature section of the thermodynamic cycle, and the section between the bottoms of the TES containers is called a low temperature section of the thermodynamic cycle.

Once, the charging process has been finished, the energy is stored until a demand for electricity is present, and discharging starts. During discharging, the hot gas from the first TES container 5A is leaving the container 5 at the top and expanding in an expander 3 towards the low-pressure in the second TES container 4. The expander 3 drives the motor/generator 1 to produce electricity, for example for giving it back to the electricity grid for general consumption. The expansion of the hot gas in the expander 3 leads to cooling of the gas. The cooled gas is then supplied to the top of the second TES container 4 in which it is further cooled by thermal transfer to the second TES medium 4' on its way to the bottom. The cold gas leaves the second TES container 4 at the bottom and is, after compression and corresponding increase of temperature, added to the bottom of the first TES container 5 where it is heated up by the first TES medium 5' during its flow from the bottom to the top of the first TES container 5.

As already discussed, the temperature gradient is advantageously maintained steep in the transition regions with the thermocline zones 4C and 5C. However, as discussed in the introduction, it is common that the thermocline degrades during the charge and discharge, especially during repeated cycles. When the thermocline zones 4C, 5C moves through the respective container 4, 5, the thermocline flattens.

When adding a commercial perspective, a decision concerning use of surplus energy for the charging depends on the actual electricity price, as it is stored and released with a certain charging/discharging efficiency and later sold again back to the grid when the electricity price is higher. For profitability, the difference in electricity price during charging and discharging should be higher than the energy loss in the system due to the charging and discharging as well as costs for maintenance and amortisation.

Figure 2:
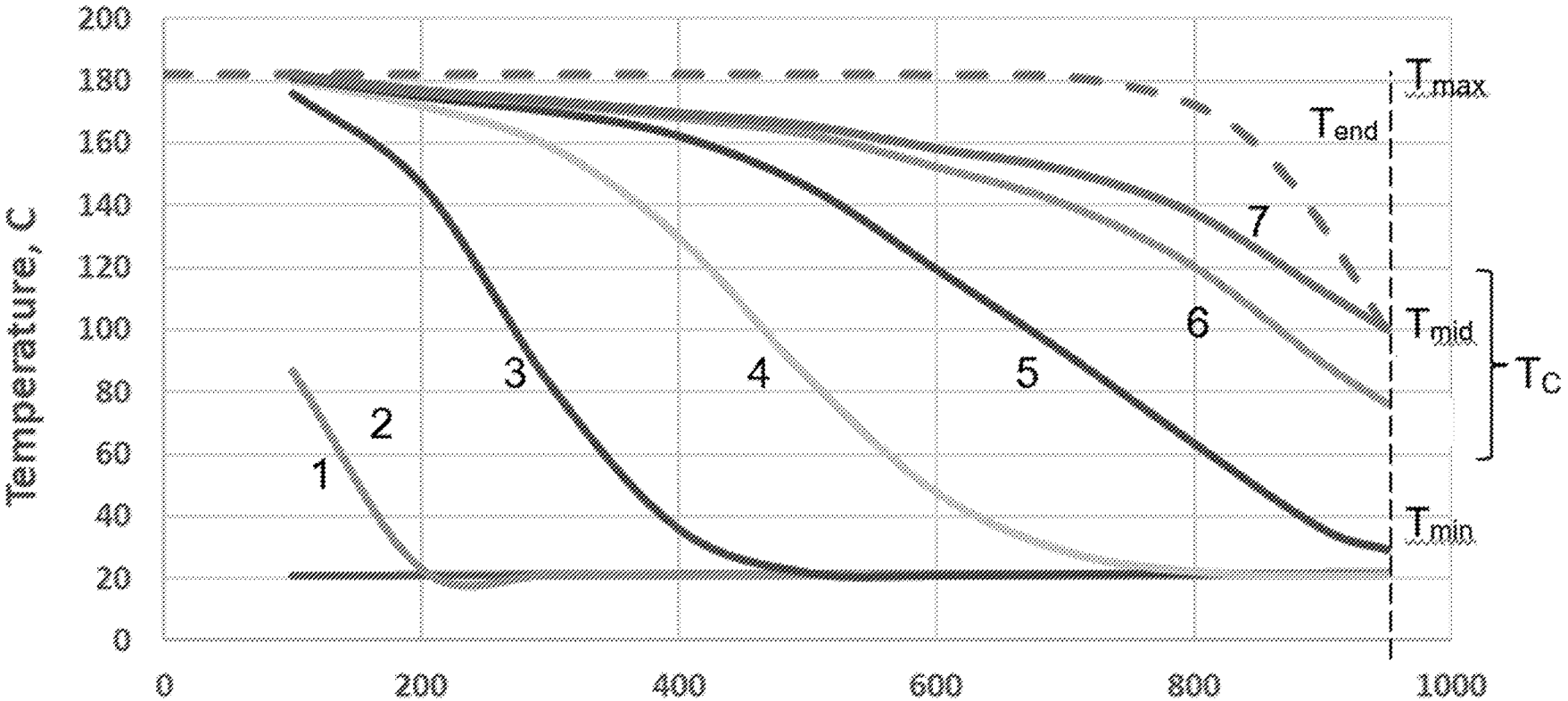
FIG. 2 illustrates thermocline development in dependence of charging time.

FIG. 2 illustrates general examples of thermocline development, showing temperature profiles along a TES medium in a TES container after various charging times in hours, which are indicated by numbers next to the various curves. It is observed that thermo-dine for the 3 hour long charging time is substantially steeper than the 5 hour thermocline. If the charging is stopped after 5 hours, and a discharging begins, the transition region will move in the opposite direction, however leading to a further flattening of the thermocline. Accordingly, there is a need for optimization.

FIG. 2 is used as offset for explaining how such optimization can be achieved. The figure illustrates that heating of the TES medium during charging by more than 5 hours results in the temperature $T_{end}$ at the end of the TES medium being raised substantially above the minimum temperature $T_{min}$ of 20° C., which is equivalent to the thermocline being pushed more and more out of the container with increasing temperature $T_{end}$.

When observing the three curves related to 5, 6 and 7 hours charging, respectively, it is seen that at 5 hours, the temperature $T_{end}$ at the end of the medium has only risen slightly above $T_{min}$. At 6 hours charging time, the shift of $T_{end}$ relatively to the 5 hour charging is up to 75° C., which is substantial relatively to the 30° C. for the 5 hour charging. However, the increase is slowing down at longer charging times, which is reflected by the smaller increase of $T_{end}$ between the 6 and the 7 hours charging time. At 7 hours, the temperature at the end of the container is at $T_{mid}$=100° C., which is midway between the minimum temperature $T_{min}$=20° C. and the maximum temperature $T_{max}$=180° C. At longer charging times, the temperature $T_{end}$ at the end of the medium rises further. However, as seen from the development from 6 hours and to 7 hours charging time as compared to the development from 5 to 6 hours, the increase of the temperature $T_{end}$ at the end of the medium slows down for additional charging time. From this simple example, it is understood that the increase of the temperature $T_{end}$ at the end of the medium is fastest in the region 30° C. to 80° C. for $T_{end}$, and slower between 80° C. and 100° C., and even slower above 100° C., although in practice still acceptable up to 120° C.

In practice, for the specific example in FIG. 2, a good lower value for $T_{end}$ with respect to counteract the flattening of the thermal front is around 60° C. The criterion for this choice is a substantial increased temperature $T_{end}$ at the end of the TES medium by small additional charging time relatively to the state where the entire thermocline, as with 4 hours charging time, or almost entire thermocline, as with 5 hours charging time, is kept inside the medium. A good upper value for $T_{end}$ with respect to counteract the flattening of the thermal front is 120° C. In this case, the criterion is substantial steepening of the thermocline within a charging time regime that is still acceptable, especially if the price for electricity is low. Above 120° C., the increase of $T_{end}$ becomes very slow with charging time and does, typically, not justify the additional charging time and thermal loss.

Accordingly, the optimal interval for thermocline control is semi-qualitatively found to be in the range of 60° C. to 120° C., which is indicated with an open bracket in FIG. 2.

When the temperature $T_{end}$ is within this interval, it is regarded as a good temperature level $T_C$ for thermocline control.

The predetermined thermocline control level $T_C$ is the level to which the temperature $T_{end}$ is raised during charging, where the charging is stopped, when $T_{end}=T_C$. As it appears from the above, this thermocline control temperature $T_C$ is predetermined in relation to various considerations, including the acceptable loss of thermal energy due to the control of the thermocline and the gain in overall efficiency by steepening the gradient.

With reference to FIG. 2, the narrowness of the interval of 60° C. to 120° C. for $T_C$ relatively to the interval $\Delta T=T_{max}-T_{min}$, and the asymmetry around the middle temperature $T_{mid}$ of 100° C. is surprising, especially in view of the relatively simple assumptions leading to this for practical purposes highly useful result. In practice, the result has proven to provide a very good compromise between, on the one hand, additional charging time for pushing the thermocline out of the container and, thus, loss of thermal energy, and, on the other hand, maintenance of a relatively steep thermocline gradient, which increases performance.

Translating these exemplified numbers of FIG. 2 to fractions of $\Delta T=T_{max}-T_{min}$, in order to generalize the concept to other storage systems, leads to $T_C$ being in the approximate interval of $$T_C \in [T_{min}+0.25\Delta T; T_{min}+0.65\Delta T], \text{ where } \Delta T=T_{max}-T_{min}.$$

Expressed in percentages of $\Delta T$, $T_C$ is optimally within the interval of 25-65% of $\Delta T$ above Tmin.

This is equivalent to the interval of.

$$T_C \in [T_{mid}-0.25\Delta T; T_{mid}+0.15\Delta T]$$

with $T_{mid}$ being the temperature midway between $T_{max}$ and $T_{min}$.

In those cases where a narrower interval is desired due to more efficient thermocline control, the interval is optionally given by $$T_C \in [T_{min}+0.35\Delta T; T_{min}+0.65\Delta T], \text{ where } \Delta T=T_{max}-T_{min}.$$

which is equivalent to $$T_C \in [T_{mid}-0.15\ \Delta T; T_{mid}+0.15\ \Delta T],$$

which is symmetric around $T_{mid}$.

Although, this interval is relatively narrow and useful for practical applications, a further optimization is found by taking into regard economical profitability. Under these considerations, the selection of $T_C$ depends on the actual electricity costs, having in mind that the system can be optimized with respect to profit if electrical energy is purchased when the price is low and sold again when the price is high, requiring that the selling price also covers the energy loss by the energy storage as well as amortization costs. Optimal regeneration by decreasing the width of the thermocline zone and steepening the temperature gradient may be done periodically predominantly when the electricity price is low, as such regeneration also implies a loss of thermal energy.

Electricity costs vary in dependence on various factors, including daytime/night-time, season, and geography as well as sunlight in relation to solar power plants and wind in relation to wind power plants. When the price for surplus electricity is low, for example a thermal loss by pushing the thermocline far out of the container can be more readily accepted than in times where the electricity price is not at the minimum.

Accordingly, when the price $P_{el}$ for a unit of electricity is at a minimum $P_{min}$, it may be useful to use this period for radical steepness regeneration of the gradient and reduction of the width of the thermocline zone by pushing the thermocline mostly out of the system. In this case, the optimum range $T_C$ is around and above $T_{mid}$. If the price for surplus electricity is not at the most favourable low level but still attractive for charging and control of the thermocline, for example up to a predetermined limit $P_{max}$, the better region for $T_C$ is below Lila.

If the price is above a maximum acceptable price, $P_{el}>P_{max}$, it has to be considered whether the charging is not performed or whether charging is done without optimized control of the thermocline.

By defining a range of electricity prices $P_{el}$ within an interval $[P_{min}\ P_{max}]$, the optimum predetermined end value $T_C$ for $T_{end}$ at the lower end of the TES medium during charging can be defined in various ways as a function of the price $P_{el}$ per unit electricity, $T_C(P_{el})=\text{funct}\ (P_{el})$.

In a simple example, the interval for pushing out the thermocline for optimization is delimited to two intervals for $T_C$ as a function of $P_{el}$, namely and $$T_C(P_{el}) \in [T_{min}+0.45\Delta T; T_{min}+0.65\Delta T] \text{ if } P_{min} \leq P_{el} < P_0,$$

and $$T_C(P_{el}) \in [T_{min}+0.25\ \Delta T; T_{min}+0.45\ \Delta T] \text{ if } P_0 \leq P_{el} \leq P_{max}.$$

For example, $P_0=(P_{max}+P_{min})/2$

It is put forwards here that the separation of the intervals for $T_C(P_{el})$ are not divided to above and below $T_{mid}$, but offset from $T_{mid}$ to the middle of the interval for $T_C$.

In FIG. 2 it was found in the discussion above that the steepest increase of $T_{end}$ with charging time was up to 6 hours, after which the increase was slowing down. Accordingly, for moderate and highest electricity price, it is advantageous to use the best increase of $T_{end}$ in the region up to 6 hours, whereas at lower price, the longer charging time is beneficial.

Taking offset in this discussion in relation to FIG. 2, and taking into regard that the fastest decrease with charging time is for $T_C$.

$$T_{end} \leq T_{mid}-0.15\Delta T=T_{min}+0.40\Delta T,$$

this translates this into an alternative general concept where optimization is delimited to two intervals for $T_C$ as a function of $P_{el}$, namely $$T_C(P_{el}) \in [T_{min}+0.40\Delta T; T_{min}+0.65\Delta T] \text{ if } P_{min} \leq P_{el} < P_0,$$

and $$T_C(P_{el}) \in [T_{min}+0.25\Delta T; T_{min}+0.40\Delta T] \text{ if } P_0 \leq P_{el} \leq P_{max}.$$

For example, $P_0=(P_{max}+P_{min})/2$

In some cases, it is assumed that above $P_{max}$, the electricity is too expensive for storage by the system and is rather used for instant consumption in the electricity network.

As the costs for surplus electricity may vary between $P_{min}$ and $P_{max}$, an interpolation can be made between the end points of the interval $$T_{end} \in [T_{mid}-0.25\Delta T; T_{mid}+0.15\Delta T].$$

As a result, for a certain range of electricity prices $P_{el} \in [P_{min}; P_{max}]$ there can be constructed a one-to-one interpolated relationship for the temperature $T_{end}$ at the end of the container relatively to the electricity price $P_{el}$.

Figure 3:
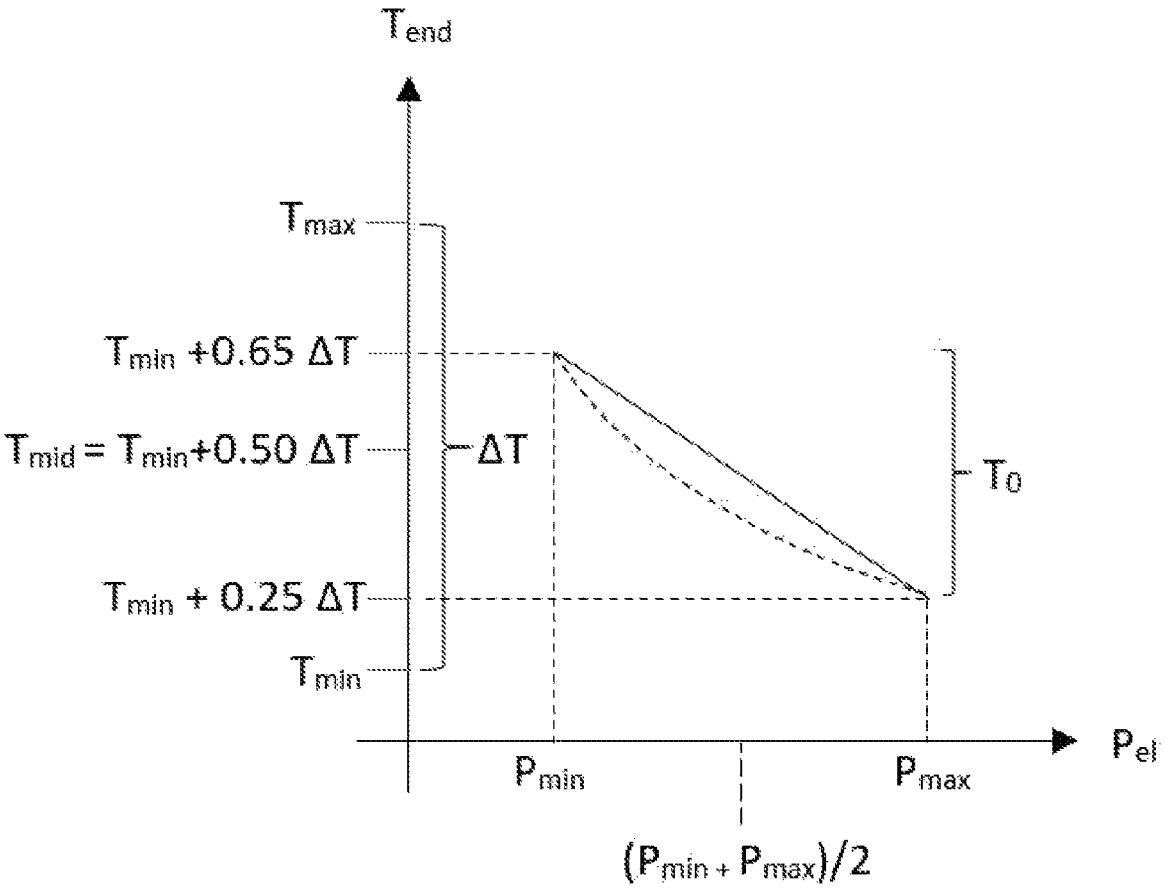
FIG. 3 illustrates optional interpolation for $T_C$ in dependence of electricity prices $P_{el}$.

In FIG. 3, a linear interpolation is illustrated with the electricity price between a minimum price $P_{min}$ and a maximum price $P_{max}$ in the interval $$T_C \in [T_{min}+0.25\Delta T; T_{min}+0.65\Delta T]$$

$$\Delta T = T_{max} - T_{min}$$

$$T_C(P_{min}) = T_{min}+0.65\Delta T$$

$$T_C(P_{max}) = T_{min}+0.25\Delta T$$

Other interpolations than linear are possible, for example curved, such as hyperbolic. A stippled hyperbolic curve is illustrated in FIG. 3, for which $T_C(P_{el})$ at the point $(P_{min}+P_{max})/2$ attains a value $T_C((P_{min}+P_{max})/2)=T_{min}+0.40\ \Delta T$.

However, the first order, linear approximation has proven to be a good solution for practical purposes.

On the basis of this expression, the price $P_{el}$ for electricity determines how much the thermocline is pushed out of the system, which is equivalent to the accepted temperature $T_{end}$ at the end of the container.

The corresponding interpolation curve shown in FIG. 3 has not been extended beyond the points $P_{min}$ and $P_{max}$ but can be done so in accordance with corresponding definitions, For example $P_{max}$ may be set as the upper limit for an electricity price at which it is still commercially feasible to perform charging and later selling of the electricity by discharging.

In case that $P_{min}$ cannot be determined due to uncertainty of what the lowest price is in practice, $P_{min}$ can be set to a minimum value at which or below of which, $T_{end}$ is set to $T_{mid}+0.15\ \Delta T$. The corresponding expression in this case becomes $$T_C(P_{el} \leq P_{min}) = T_{min}+0.65\Delta T.$$

A linear curve as illustrated in FIG. 3 is a good and simple approximation for other possibly optimized curves, which potentially are hyperbolic or parabolic, as indicated with the stippled curve. The construction of these curves follows the same principles, and the linear first order approximation is an example only, although a useful example in practice.

Such linear function can be expressed as $$T_{end} = \text{funct}(P_{el}) = -\alpha P_{el} + T_0, \text{ where } \alpha = -0.4\Delta T/(P_{max} - P_{min}) + T_0$$

where $T_0$ can be determined by solving the two linear expressions once $\Delta T$ and $(P_{max}-P_{min})$ are known.

$$T_{end}(P_{min}): -\alpha P_{min} + T_0 = T_{mid} + 0.15\Delta T$$

$$T_{end}(P_{max}): -\alpha P_{max} + T_0 = T_{mid} - 0.25\Delta T$$

Although, the optimum curve is not truly linear, in practical applications, the first order approximation with the linear curve yields good results.

In order to influence the temperature $T_{end}$ at the end of the container, an electrical heater 7 may be supplied, which would influence the temperature characteristics. The electrical energy supplied to the heater 7 must be balanced relatively to the effect of control of the thermocline. However, in certain cases, the supply of electrical energy to the system is advantageously a combination of electrical energy to the converter and electrical energy to a heater at a lower end of the first TES medium.

By defining optimized control of the thermocline by a limit $T_C$ for the end temperature $T_{end}$, the necessary number of parameters are minimized. However, in order to actually measure the development of the temperature profile in the container in order to determine the thermocline, the thermal storage containers are optionally provided with temperature gauges that measure at various points through the container. When charging is stopped and there is no flow through the container, measurements are not disturbed by the flow of fluid, and a proper temperature profile can be determined.

The invention claimed is:

1. A method of operating a thermal energy storage (TES) system comprising a thermodynamic fluid cycle including a first TES container and an energy converter for converting between electrical energy and thermal energy of working fluid in the thermodynamic fluid cycle; wherein the first TES container has a top and a bottom and contains a first TES medium for storing thermal energy, the first TES medium having an upper end and a lower end, wherein the top of the first TES container is connected to a hot working fluid section of the thermodynamic fluid cycle and the bottom of the first TES container is connected to a cold working fluid section of the thermodynamic fluid cycle, the method comprising:

during a period of charging, supplying electrical energy to the energy converter and converting the electrical energy to added thermal energy in the working fluid for raising a temperature of the working fluid to $T_{max}$;

providing the working fluid at $T_{max}$ to the top of the first TES container, transferring thermal energy from the working fluid to the first TES medium by flow of the working fluid from the upper end to the lower end, providing a temperature gradient from $T_{max}$ to $T_{min}$ in the first TES medium, where $T_{min}<T_{max}$, and moving the temperature gradient towards the lower end during the charging, wherein the temperature gradient is contained in a thermocline zone of the first TES medium, by supplying electrical energy to the TES system, raising the temperature of the first TES medium at the lower end ($T_{end}$) from $T_{min}$ only until $T_{end}$ reaches a predetermined control temperature $T_C$, predetermining and selecting $T_C$ within a thermocline control interval defined by: $T_C \in [T_{min}+0.25\ \Delta T;\ T_{min}+0.65\ \Delta T]$, where $\Delta T = T_{max} - T_{min}$.

2. The method according to claim 1, further comprising:

defining a price $P_{max}$ for a unit of electricity as a maximum profitable price for thermocline control in the TES system;

receiving an actual price $P_{act}$ for a unit of electricity valid for a planned time of charging; and determining whether $P_{act}<P_{max}$, and only in the affirmative raising the temperature of the first medium at the lower end $T_{end}$ to the predetermined control level $T_C$ within the thermocline control interval.

3. The method according to claim 1, further comprising:

defining a decreasing function $T_C(P_{el})=\text{funct}\ (P_{el})$, in which $T_C(P_{el})$ is dependent on a varying price $P_{el}$ for a unit of electricity, and $T_C(P_{el})$ is decreasing within the thermocline control interval for increasing $P_{el}$ within an interval $[P_{min};\ P_{max}]$ of electricity prices, wherein $T_C(P_{min})=T_{min}+0.65\ \Delta T$ and $T_C(P_{max})=T_{min}+0.25\ \Delta T$;

receiving an actual price $P_{act}$ for a unit of electricity valid for a planned time of charging;

determining $T_C(P_{act})$; and supplying electrical energy to the TES system only until the $T_{end}$ reaches the $T_C(P_{act})$.

4. The method according to claim 3, further comprising providing $T_C\ (P_{el})=\text{func}\ (P_{el})$ as a continuous function.

5. The method according to claim 3, further comprising predetermining a price level $P_0 \in [P_{min}; P_{max}]$, and predetermining $T_C(P_{el})$=funct $(P_{el})$ as a function of the price $P_{el}$ according to the following intervals, $$T_C(P_{el}) \in [T_{min}+0.45\Delta T; T_{min}+0.65\Delta T] \text{ if } P_{min} \leq P_{el} < P_0,$$

$$T_C(P_{el}) \in [T_{min}+0.25\Delta T; T_{min}+0.45\Delta T] \text{ if } P_0 \leq P_{el} \leq P_{max}.$$

6. The method according to claim 5, wherein $P_0=(P_{max}+P_{min})/2$.

7. The method according to claim 3, further comprising predetermining $T_C(P_{el})=T_{min}+0.65\ \Delta T$ if $P_{el} \leq P_{min}$.

8. The method according to claim 2, further comprising and only charging the TES system by electricity consumption if $P_{act}<P_{max}$.

9. The method according to claim 1, wherein the working fluid is a gas and the energy converter comprises a motor-driven compressor configured for raising the temperature of the gas during the charging period by compressing the gas.

10. The method according to claim 9, wherein the energy converter also comprises an expander-driven generator for generating electricity in a discharging period by expanding the gas through an expander and driving the expander by expansion; wherein the TES system comprises a second TES container with a second TES medium; the method further comprising:

interconnecting the top of the first TES container and a top of the second TES container through the compressor and interconnecting the bottom of the first TES container and a bottom of the second TES container through the expander during charging and transferring thermal energy from the second TES medium to the first TES medium during charging, and interconnecting the top of the first TES container and the top of the second TES container through the expander and interconnecting the bottom of the first TES container and the bottom of the second TES container through the compressor during discharging and transferring thermal energy from the first TES medium to the second TES medium during discharging;

wherein compression in the compressor and expansion in the expander are adiabatic and thermal transfer between the gas and the first TES medium and the gas and the second TES medium is isobaric.

11. The method according to claim 1, further comprising raising $T_{end}$ to $T_C$ by supplying electrical energy to the energy converter and by its conversion of the electrical energy to thermal energy.

12. The method according to claim 1, wherein the supply of electrical energy to the TES system is a combination of electrical energy to the converter and electrical energy to a heater at the lower end of the first TES medium (5').

13. The method according to claim 4, wherein the continuous function is a linear function.

14. The method according to claim 4, further comprising predetermining a price level $P_0 \in [P_{min}, P_{max}]$, and predetermining $T_C(P_{el})$=funct $(P_{el})$ as a function of the price $P_{el}$ according to the following intervals, $$T_C(P_{el}) \in [T_{min}+0.45\Delta T; T_{min}+0.65\Delta T] \text{ if } P_{min} \leq P_{el} < P_0,$$

$$T_C(P_{el}) \in [T_{min}+0.25\Delta T; T_{min}+0.45\Delta T] \text{ if } P_0 \leq P_{el} \leq P_{max}.$$

15. The method according to claim 14, wherein $P_0=(P_{max}+P_{min})/2$.

* * * * *